US007669616B2

(12) United States Patent
Bruengger

(10) Patent No.: US 7,669,616 B2
(45) Date of Patent: Mar. 2, 2010

(54) APPARATUS FOR PUNCTURING A GAS FILLED BOTTLE

(75) Inventor: Craig V. Bruengger, Norwell, MA (US)

(73) Assignee: Ultra Electronics Ocean Systems, Inc., Braintree, MA (US)

( * ) Notice: Subject to any disclaimer, the term of this patent is extended or adjusted under 35 U.S.C. 154(b) by 654 days.

(21) Appl. No.: 11/613,419

(22) Filed: Dec. 20, 2006

(65) Prior Publication Data

US 2008/0149217 A1 Jun. 26, 2008

(51) Int. Cl.
*B65B 31/00* (2006.01)
*B67D 5/00* (2006.01)
*B63C 9/15* (2006.01)

(52) U.S. Cl. ..... 141/19; 141/329; 141/330; 222/5; 137/68.3; 441/93

(58) Field of Classification Search ..... 141/19, 141/329, 330; 441/93; 222/3, 5; 137/68.29, 137/68.3

See application file for complete search history.

(56) References Cited

U.S. PATENT DOCUMENTS

| | | | | |
|---|---|---|---|---|
| 3,048,303 | A * | 8/1962 | Spidy et al. | 222/5 |
| 3,547,165 | A * | 12/1970 | Butterworth | 222/5 |
| 3,597,780 | A * | 8/1971 | Coyle | 441/94 |
| 4,867,209 | A * | 9/1989 | Santoiemmo | 141/19 |
| 4,972,971 | A * | 11/1990 | Janko et al. | 222/5 |
| 6,991,005 | B2 * | 1/2006 | Fedeli | 141/114 |

* cited by examiner

*Primary Examiner*—Timothy L Maust
(74) *Attorney, Agent, or Firm*—Daly, Crowley, Mofford & Durkee, LLP

(57) ABSTRACT

Apparatus for puncturing a gas filled bottle uses a spring force upon an inflator tack, which punctures the gas filled bottle, rather than a manual or explosive force. The spring force is retained prior to puncturing the bottle by a retention element disposed in a hole. The retention element is released upon actuation of the apparatus.

20 Claims, 2 Drawing Sheets

APPARATUS FOR PUNCTURING A GAS FILLED BOTTLE

CROSS REFERENCE TO RELATED APPLICATIONS

Not Applicable.

STATEMENT REGARDING FEDERALLY SPONSORED RESEARCH

Not Applicable.

FIELD OF THE INVENTION

This invention relates generally mechanisms used for puncturing an object and, more particularly, to an apparatus for puncturing a gas filled bottle, the apparatus having a spring that provides the puncturing force.

BACKGROUND OF THE INVENTION

It is necessary to puncture a gas filled bottle in conjunction with many mechanical systems. For example, in order to rapidly inflate a life vest used in the water, some life vests are equipped with a small gas bottle filled with pressurized carbon dioxide, which is punctured with an inflation mechanism in order to inflate the life vest. In some life vests, the inflation mechanism is manually operated by a user, for example, by a pull on a cord. These mechanisms generally have a pin (or inflation tack), which punctures an end of the gas filled bottle in response to a force upon the pin supplied manually by the person pulling the cord.

Some other inflation mechanisms are electrically actuated, and puncture the gas bottle in response to an electrical signal. In some conventional electrically actuated inflation mechanisms, the inflation mechanism includes an electrically actuated explosive device, a so-called squib, which provides the force upon the pin in order to puncture the gas filled bottle.

As is known, squibs can cause unintended damage, and, for this reason, cannot be shipped by some conventional shipping means. It is felt, for example, than a squib explosion in the storage hold of an aircraft due to a malfunction can present a danger to the aircraft.

It is desirable to provide an apparatus for puncturing a gas filled bottle, which is electrically actuated, but which does not include an explosive device.

SUMMARY OF THE INVENTION

The present invention provides an apparatus for puncturing a gas filled bottle using s spring force rather than a manual force or a squib-generated force.

In accordance with one aspect of the present invention, apparatus for puncturing a gas filled bottle includes a push rod having a longitudinal axis, having a first end, having a second end, and having an outer surface. The outer surface of the push rod has a tapered region tapering toward the longitudinal axis of the push rod in a direction toward the second end of the push rod. The apparatus further includes a barrel cap having a longitudinal axis, having a first end, having a second end, having an outer surface, and having an inner surface. The barrel cap includes a hole extending from the outer surface of the barrel cap to the inner surface of the barrel cap. The push rod is disposed within the barrel cap so that at least a portion of the outer surface of the push rod is in proximity to at least a portion of the inner surface of the barrel cap. The push rod is disposed within the barrel cap so that the tapered surface of the push rod is in proximity to the hole. The apparatus also includes a barrel ram having a longitudinal axis, having a first end, having a second end, and having an inner surface. The inner surface of the barrel ram has a tapered region tapering away from the longitudinal axis of the barrel ram in a direction toward the second end of the barrel ram. The barrel cap is disposed within the barrel ram so that at least a portion of the outer surface of the barrel cap is in proximity to at least a portion of the inner surface of the barrel ram. The barrel cap is disposed within the barrel ram so that the tapered surface of the barrel ram is in proximity to the hole. The apparatus further includes a retention element disposed in the hole and disposed to contact the tapered surface of the push rod and to contact the tapered surface of the barrel ram. The apparatus further includes a spring adapted to provide a spring force pushing the first end of the push rod away from the second end of the barrel ram.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Before describing the present invention, some introductory concepts and terminology are explained. As used herein, the term "squib" is used to describe a small explosive device.

Figure 1:
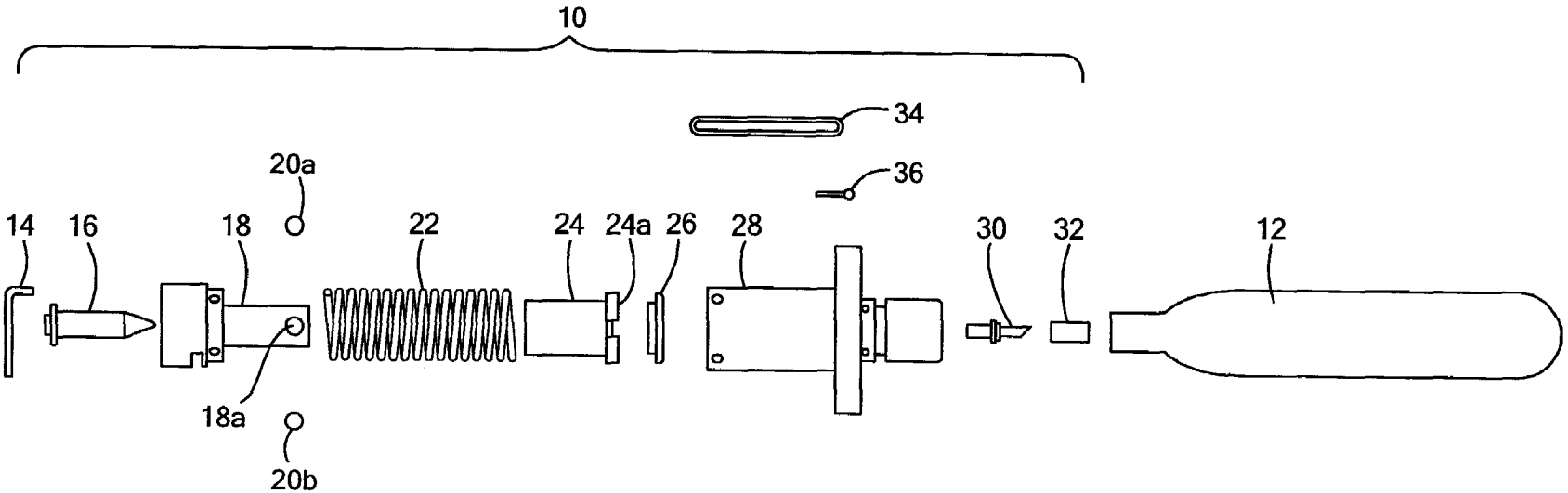
FIG. 1 is an exploded view showing parts of an exemplary apparatus for puncturing a gas filled bottle.

Referring to FIG. 1, an exemplary apparatus 10 is adapted to couple to a gas filled bottle 12, for example, a bottle filed with pressurized carbon dioxide. The apparatus 10 includes a release arm 14, a push rod 16, and a barrel cap 18. The barrel cap 18 can include one or more holes 18*a* each having a size and a shape adapted to fit a retention element 20*a* or 20*b*, for example, a round ball. The apparatus 10 also includes a spring 22, and a barrel ram 24.

In some embodiments the apparatus 10 also includes a ram cap 26 adapted to cover an end 24*a* of the barrel ram 24. However, in some other arrangements, the barrel ram 24 has a substantially sealed end 24*a* and has no ram cap 26.

The assembly 10 can also include an inflator barrel 28 adapted to receive an inflator tack 30, as will be apparent from discussion below in conjunction with FIG. 2. The inflator barrel 28 can also receive the push rod 16, the barrel cap 18, the barrel ram 24, and the barrel cap 26. In some arrangements, the assembly 10 can also include a cord 34 and a breakable member 36 coupled to the cord 34. In some embodiments, the breakable member 36 has an electrical input (not shown) and is adapted to break upon application of an electrical signal to the electrical input. In some other arrangements, the breakable member 36 is adapted to itself break upon application of the electrical signal to the electrical input. In some embodiments, the breakable member 36 is a resistor, for example, an eighth watt or a quarter watt resistor. In other embodiments, the breakable member 36 is an explosive device, for example, a squib.

The cord 34, the breakable member 36, and the release arm 14 are referred to herein as a "retention mechanism," adapted to retain the push rod 16 within the barrel cap 18 until actuation of the apparatus 10. The actuation will be better understood from discussion below in conjunction with FIG. 2.

Other arrangements of release mechanisms are discussed below in conjunctions with FIG. 2.

Figure 2:
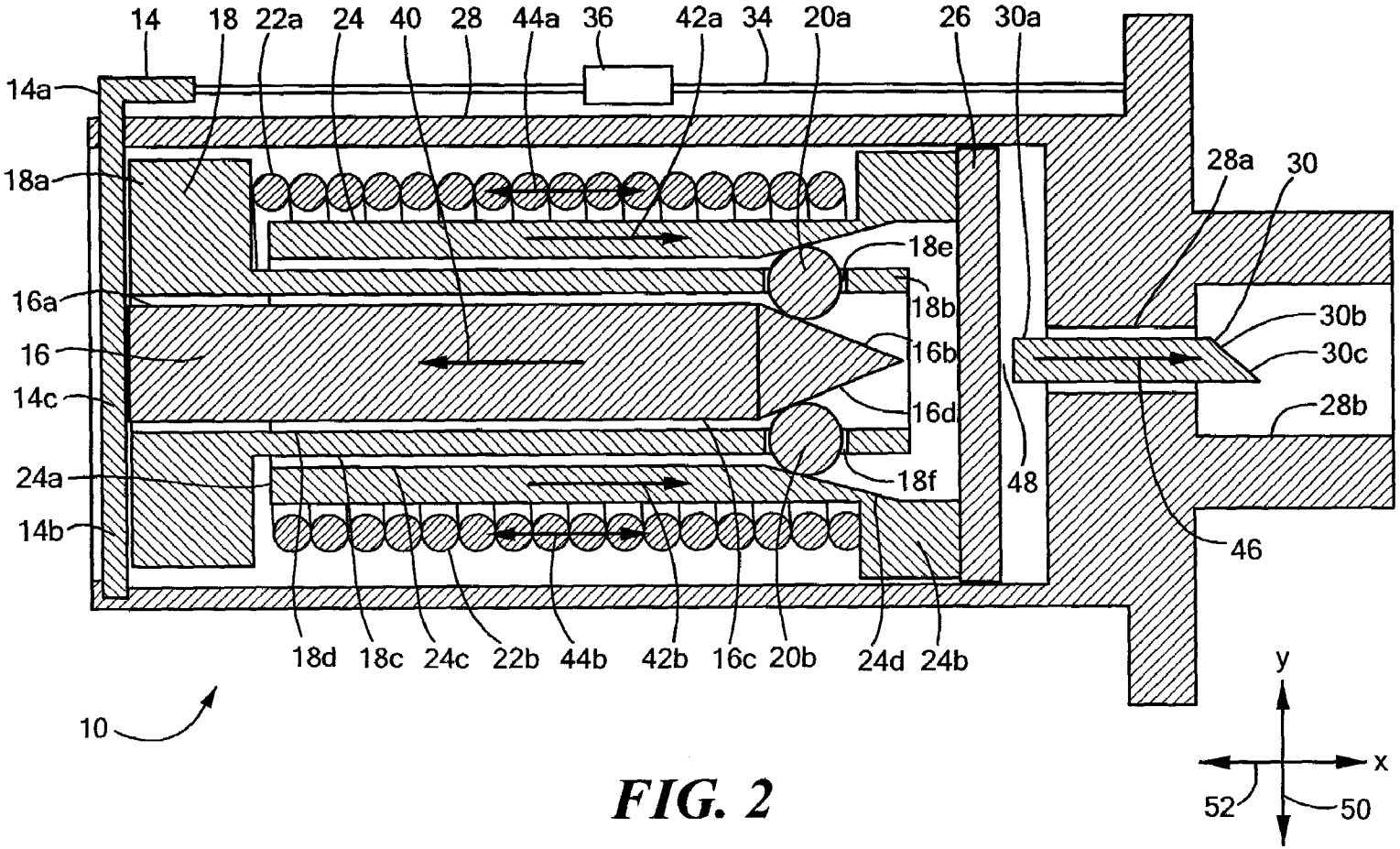
FIG. 2 is a cross-sectional view showing an assembled view of the apparatus of FIG. 1.

Referring now to FIG. 2, in which like elements of FIG. 1 are shown having like reference designations, the apparatus 10 can include the push rod 16 having a longitudinal axis (along an x-axis 50). The push rod 16 includes a first end 16*a*, a second end 16*b*, and an outer surface 16*c*. The outer surface 16*c* of the push rod 16 has a tapered region 16*d*, tapering toward the longitudinal axis of the push rod 16 in a direction toward the second end 16*b* of the push rod 16. The apparatus 10 can also include the barrel cap 18 having a longitudinal axis (along the x-axis 50). The barrel cap 18 includes a first end 18*a*, a second end 18*b*, an outer surface 18*c*, and an inner surface 18*d*. The barrel cap 18 includes at least one hole 18*e*, 18*f* (here shown as two holes) extending from the outer surface 18*c* of the barrel cap 18 to the inner 18*d* surface of the barrel cap 18.

The push rod 16 is disposed within the barrel cap 18 so that at least a portion of the outer surface 16*c* of the push rod 16 is in proximity to at least a portion of the inner surface 18*d* of the barrel cap 18. The push rod 16 is disposed within the barrel cap 18 so that the tapered surface 16*d* of the push rod 16 is in proximity to the holes 18*e*, 18*f*.

The apparatus 10 can also include the barrel ram 24 having a longitudinal axis (along the x-axis 50). The barrel ram has a first end 24*a*, a second end 24*b*, and an inner surface 24*c*. The inner surface 24*c* of the barrel ram 24 has a tapered region 24*d*, tapering away from the longitudinal axis of the barrel ram 24 in a direction toward the second end 24*b* of the barrel ram 24.

The barrel cap 18 is disposed within the barrel ram 24 so that at least a portion of the outer surface 18*c* of the barrel cap 18 is in proximity to at least a portion of the inner surface 24*c* of the barrel ram 24. The barrel cap 18 is disposed within the barrel ram 24 so that the tapered surface 24*d* of the barrel ram 24 is in proximity to the holes 18*e*, 18*f*.

The apparatus 24 can include the at least one retention element 20*a*, 20*b* (here shown at two retention elements) disposed in the holes 18*e*, 18*f*, respectively, and disposed to contact the tapered surface 16*d* of the push rod 16 and to contact the tapered surface 24*d* of the barrel ram 24. The apparatus can also include the spring 22*a*, 22*b* (here shown as one spring) which is adapted to provide a spring force 44*a*, 44*b*, pushing the first end 16*a* of the push rod 16 away from the second end 24*b* of the barrel ram 24.

The apparatus 10 can also include the inflator tack 30 having first and second ends 30*a*, 30*b*, respectively. The first end 30*a* of the inflator tack 30 is disposed nearer than the second end 30*b* of the inflator tack 30 to the second end 24*b* of the barrel ram 24. The second end 30*b* of the inflator tack 30 is disposed nearer than the first end 30*a* of the inflator tack 30 to the gas filled bottle (12, FIG. 1). The second end 30*b* of the inflator tack 30 has a point 30*c* adapted to pierce the gas filled bottle 12. The spring 22 is adapted to provide the spring force 44*a*, 44*b* to the first end 30*a* of the inflator tack 30 in a direction toward the second end of the inflator tack 30*b*, the force 44*a*, 44*b* sufficient to cause the inflator tack 30 to puncture the gas filled bottle 12.

In some embodiments, the spring 22*a*, 22*b* is a single spring having an inner diameter that can accept the barrel ram 24. However, in some other embodiments, the spring 22*a*, 22*b* can be comprised of one or more springs disposed generally outside of the outer surface 24*c* of the barrel ram 24. In some embodiments, the retention elements 20*a*, 20*b* are balls, for example, round ball bearings. However, in other embodiments, other retention elements having other shapes are possible.

The apparatus 10 can also include the release arm 14 (also referred to herein as a pivot structure) having a first end 14*a*, a second end 14*b*, and a lever region 14*c*. The second end 14*b* of the release arm 14 is pivotally retained to the inflator barrel 28. The lever region is proximate to the first end 16*a* of the push rod 16 and can apply a force upon the first end 16*a* of the push rod 16 to retain the push rod 16 within the barrel cap 18.

In a "retained" state, elements of the assembly 10 are held in the positions shown, retarding the spring force 44*a*, 44*b*. It should be understood that the retention mechanism, which is comprised of the release arm 14, the cord 34, and the breakable structure 36 operate to retain the barrel cap 18, and therefore the push rod 16, from moving in a direction 40. Accordingly, the barrel ram 24 is also retained from moving in a direction 42*a*, 42*b*, and therefore, the inflator tack 30 does not move in a direction 46.

When actuated, in response to an electrical input (not shown) to the breakable member 36, the breakable member 36 separates, and the cord 34 releases the release arm 14. In response to the spring force 44*a*, 44*b*, the release arm pivots about a pivot point 14*b*, allowing the push rod 16 to move in the direction 40. When the push rod 16 moves in the direction 40, the retention elements 20*a*, 20*b* move along an x-axis 52, allowing the barrel ram 24 and associated ram cap 26 to move in the direction 42*a*, 42*b*, with a relatively high velocity. The barrel cap 26 strikes the inflator tack 30, causing the sharp point 30*c* of the inflator tack 30 to puncture the gas filled bottle 12 of FIG. 1.

The gas filled bottle is retained in the inflator barrel 28, for example, with threads (not shown) on an inner surface 28*b* of the inflator barrel 28.

As described above, the barrel ram 24, which is shown having an open second end 24*b*, which is covered by the ram cap 26, can, in other embodiments, have a sealed second end 24*b*. In these arrangements, no ram cap 26 is needed, and the barrel ram 24 strikes the inflator tack 30.

In some embodiments, in the above-described retained state, a gap 48 between the ram cap 26 and the first end 30*a* of the inflator tack 30, allows the ram cap 26 to impact the inflator tack 30 with greater impact velocity than if no gap 48 were present. The amount of puncturing force provided by the inflator tack 30 can be controlled by the size of the gap 48.

While the breakable member 36 is shown to be in series with the cord 34, in other embodiments, the cord 34 is continuous and the breakable member 36 is in contact with the cord 34. In these embodiments, in response to an electrical input (not shown) to the breakable member 36, the breakable member 36 causes the cord to break, for example, by burning or melting the cord 34. For example, where the breakable member 36 is a resistor, heat from the resistor can break the cord 34. In some arrangements, the cord 34 is a nylon cord, adapted to melt in response to heat provided by the breakable member 36. However, other synthetic fiber cords 34 can also be used.

In some arrangements, the breakable member 36 is a pyrotechnic device, for example, a squib, which is either in series with the cord 34 or in close proximity to the cord 34. In these arrangements, an electrical input to the pyrotechnic device cause the pyrotechnic device to explode and the cord 34 to separate.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. Apparatus for puncturing a gas filled bottle, comprising:

a push rod having a longitudinal axis, having a first end, having a second end, and having an outer surface, wherein the outer surface of the push rod has a tapered region tapering toward the longitudinal axis of the push rod in a direction toward the second end of the push rod;

a barrel cap having a longitudinal axis, having a first end, having a second end, having an outer surface, and having an inner surface, wherein the barrel cap comprises a hole extending from the outer surface of the barrel cap to the inner surface of the barrel cap, wherein the push rod is disposed within the barrel cap so that at least a portion of the outer surface of the push rod is in proximity to at least a portion of the inner surface of the barrel cap, and wherein the push rod is disposed within the barrel cap so that the tapered surface of the push rod is in proximity to the hole;

a barrel ram having a longitudinal axis, having a first end, having a second end, and having an inner surface, wherein the inner surface of the barrel ram has a tapered region tapering away from the longitudinal axis of the barrel ram in a direction toward the second end of the barrel ram, wherein the barrel cap is disposed within the barrel ram so that at least a portion of the outer surface of the barrel cap is in proximity to at least a portion of the inner surface of the barrel ram, and wherein the barrel cap is disposed within the barrel ram so that the tapered surface of the barrel ram is in proximity to the hole;

a retention element disposed in the hole and disposed to contact the tapered surface of the push rod and to contact the tapered surface of the barrel ram; and a spring adapted to provide a spring force pushing the first end of the push rod away from the second end of the barrel ram.

2. The apparatus of claim 1, wherein the retention element disposed in the hole has a spherical shape having a diameter selected to contact the tapered surface of the push rod and the tapered surface of the barrel ram.

3. The apparatus of claim 2, further comprising an inflator tack having a first end and having a second end, wherein the second end has a point adapted to pierce the gas filled bottle, wherein the first end of the inflator tack is disposed nearer than the second end of the inflator tack to the second end of the barrel ram, and wherein the sharp point of the inflator tack is disposed nearer than the first end of the inflator tack to the gas filled bottle.

4. The apparatus of claim 2, further comprising a retention mechanism adapted to retain the push rod within the barrel cap.

5. The apparatus of claim 4, wherein the retention mechanism comprises a pivot structure having a first end, having a second end, and having a lever region, wherein the second end is pivotally retained, wherein the retention mechanism is disposed so that the lever region is proximate to the first end of the push rod so as to retain the second end of the push rod within the barrel cap.

6. The apparatus of claim 5, wherein the retention mechanism further comprises a severable structure coupled to the first end of pivot structure and adapted to retain the first end of the pivot structure.

7. The apparatus of claim 6, wherein the severable structure comprises a breakable member having an electrical input, wherein the breakable member is adapted to break upon application of an electrical current to the electrical input.

8. The apparatus of claim 6, wherein the severable structure comprises:

a cord coupled to the first end of the pivot structure; and a breakable structure coupled to the cord, wherein the breakable structure is adapted to break upon application of an electrical current to the electrical input.

9. The apparatus of claim 6, wherein the severable structure comprises:

a cord coupled to the first end of the pivot structure; and an electrical structure coupled to the cord, wherein the breakable structure is adapted to break the cord upon application of an electrical current to the electrical input.

10. The apparatus of claim 6, wherein the severable structure comprises a pyrotechnic element.

11. The apparatus of claim 5, further comprising an inflator tack having a first end and having a second end, wherein the second end has a point adapted to pierce the gas filled bottle, wherein the first end of the inflator tack is disposed nearer than the second end of the inflator tack to the second end of the barrel ram, and wherein the sharp point of the inflator tack is disposed nearer than the first end of the inflator tack to the gas filled bottle.

12. The apparatus of claim 11, wherein the retention element has a spherical shape having a diameter selected to contact the tapered surface of the push rod and the tapered surface of the barrel ram.

13. The apparatus of claim 1, further comprising a retention mechanism adapted to retain the push rod within the barrel cap.

14. The apparatus of claim 1, further comprising an inflator tack having a first end and having a second end, wherein the second end has a point adapted to pierce the gas filled bottle, wherein the first end of the inflator tack is disposed nearer than the second end of the inflator tack to the second end of the barrel ram, and wherein the sharp point of the inflator tack is disposed nearer than the first end of the inflator tack to the gas filled bottle.

15. The apparatus of claim 14, further comprising a retention mechanism adapted to retain the push rod within the barrel cap.

16. The apparatus of claim 15, wherein the barrel ram is adapted to move resulting in an impact upon the first end of the inflator tack in response to the spring force, the impact having sufficient force to drive the inflator tack into the sealed nozzle of the gas filled bottle.

17. The apparatus of claim 16, wherein the gas filled bottle is a sealed $CO_2$ bottle.

18. The apparatus of claim 14, wherein the barrel ram is adapted to move resulting in an impact upon the first end of the inflator tack in response to the spring force, the impact having sufficient force to drive the inflator tack into the sealed nozzle of the gas filled bottle.

19. The apparatus of claim 18, wherein the gas filled bottle is a sealed $CO_2$ bottle.

20. The apparatus of claim 1, wherein the gas filled bottle is a sealed $CO_2$ bottle.

* * * * *